US010612367B2

(12) United States Patent
Orban et al.

(10) Patent No.: US 10,612,367 B2
(45) Date of Patent: Apr. 7, 2020

(54) TOP DRIVE TOOL FACE MEASUREMENT IN RELATION TO DOWN HOLE DRILLING COMPONENTS

(71) Applicant: Schlumberger Technology Corporation, Sugar Land, TX (US)

(72) Inventors: Jacques Orban, Katy, TX (US); Vishwanathan Parmeshwar, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 85 days.

(21) Appl. No.: 15/971,576

(22) Filed: May 4, 2018

(65) Prior Publication Data

US 2019/0338635 A1 Nov. 7, 2019

(51) Int. Cl.

| | |
|---|---|
| ***E21B 47/09*** | (2012.01) |
| ***E21B 19/16*** | (2006.01) |
| ***E21B 47/00*** | (2012.01) |
| ***E21B 15/04*** | (2006.01) |
| ***E21B 7/04*** | (2006.01) |

(52) U.S. Cl.

CPC ..... *E21B 47/0905* (2013.01); *E21B 7/04* (2013.01); *E21B 15/04* (2013.01); *E21B 19/165* (2013.01); *E21B 47/0006* (2013.01)

(58) Field of Classification Search

CPC ..... E21B 47/095; E21B 7/04; E21B 15/04; E21B 19/165

See application file for complete search history.

(56) References Cited

U.S. PATENT DOCUMENTS

| | | | | |
|---|---|---|---|---|
| 9,404,307 | B2 | 8/2016 | Maidla | |
| 2015/0285055 | A1* | 10/2015 | Anderson | E21B 47/00 175/40 |
| 2019/0178043 | A1* | 6/2019 | Boone | E21B 21/08 |

* cited by examiner

*Primary Examiner* — D. Andrews
(74) *Attorney, Agent, or Firm* — Rachel E. Greene

(57) ABSTRACT

A process for directional operations in a well bore without MWD, the process comprising: engaging an upper end of a drill string with a traveling block component, wherein the traveling block component comprises a traveling block angular sensor; measuring with the traveling block angular sensor an initial angular position of the drill string; lowering the drill string in the well bore with the traveling block component; measuring with the traveling block angular sensor a final angular position of the drill string; recording an angle of rotation, if any, of the drill string between initial and final positions as measured by the traveling block angular sensor; engaging the drill string with a rig floor component, wherein the rig floor component comprises a rig floor angular sensor; measuring with the rig floor angular sensor an initial angular position of the drill string; disengaging the traveling block component from the drill string; raising the traveling block component; engaging an upper end of a first tubular with the traveling block component; joining a bottom end of the first tubular to the drill string; measuring with the rig floor angular sensor a final angular position of the drill string; and recording an angle of rotation, if any, of the drill string that occurred between initial and final positions as measured by the rig floor angular sensor.

20 Claims, 8 Drawing Sheets

TOP DRIVE TOOL FACE MEASUREMENT IN RELATION TO DOWN HOLE DRILLING COMPONENTS

TECHNICAL FIELD

The present disclosure relates to drilling rig systems and processes. In particular, the invention relates to drilling system to perform some directional drilling operations with no, or at least minimum, measurement while drilling MWD equipment in the well-bore.

BACKGROUND ART

For directional drilling, the bottom hole assembly BHA is normally equipped with a measurement while drilling MWD for determining the trajectory and a steerable machine to allow control of the trajectory of the well bore. The steerable machine may be either a steerable motor, which requires a sliding mode to steer the well, or a rotary steerable system RSS. In the low tier market and high dog-leg market, a steerable motor may be the preferred solution because of low system cost, capability of high dog-leg, and limited fatigue on the drill-string as partial sliding in the curve. Steering capability can be useful when drilling a vertical section and avoiding collision. It may also be useful to kick-off from vertical below a casing where measurement while drilling MWD magnetometer be may perturbed by the casing.

U.S. Pat. No. 9,404,307, incorporated herein in its entirety by reference, discloses a known directional drilling system. As shown in FIG. 1, a drilling rig ("rig") 11 includes a derrick 13 that is supported on the ground above a rig floor 15. The rig 11 includes lifting gear, which includes a crown block 17 mounted to the derrick 13 and a traveling block 19. The crown block 17 and the traveling block 19 are interconnected by a cable 21 that is driven by a draw works 23 to control the upward and downward movement of the traveling block 19. The traveling block 19 carries a hook 25 from which a top drive 27 may be suspended. The top drive 27 rotatably supports a drill pipe string ("drill string") 35, in a wellbore 33. The top drive 27 can be operated to rotate the drill string 35 in either direction, or to apply a selected amount of torque to the drill string 35. The drill string 35 may be coupled to the top drive 27 through an instrumented top sub 29. A surface drill string torque sensor 53 may be provided in the instrumented top sub 29. A surface drill pipe rotational orientation sensor 65 that provides measurements of drill string angular position or "surface" tool face may also be provided in the instrumented top sub 29. The instrumented top sub 29 may be a device sold by 3PS, Inc., Cedar Park, Tex. known as an "Enhanced Torque and Tension Sub."

The surface drill string torque sensor 53 may be implemented as a strain gage in the instrumented top sub 29, or as a current measurement device for an electric rotary table or top drive motor, or as a pressure sensor for a hydraulically operated top drive. The surface drill string torque sensor 53 provides a signal which may be sampled electronically. The orientation sensor 65 may be implemented as an integrating angular accelerometer (and the same may be used to provide measurements related to surface torque). Irrespective of the instrumentation used, the surface drill string torque sensor 53 provides a measurement corresponding to the torque applied to the drill string 35 at the surface by the top drive 27 or rotary table (not shown), depending on how the rig 11 is equipped. Other parameters which may be measured, such as fluid pressure in the drill string 35.

The drill string 35 may include a plurality of interconnected sections of drill pipe (tubulars or stands) (not shown separately) and a bottom hole assembly ("BHA") 37. The bottom hole assembly 37 may include stabilizers, drill collars and a suite of measurement-while-drilling ("MWD") instruments, including a MWD tool direction sensor 51. The MWD tool direction sensor 51 provides, among other measurements, tool face angle measurements, as well as wellbore geodetic or geomagnetic direction (azimuth) and inclination measurements. A steerable drilling motor ("steerable motor") 41 may be connected near the bottom of the bottom hole assembly 37. The steerable motor 41 may be a positive displacement motor, a turbine, or an electric motor that can turn the drill bit 40 independently of the rotation of the drill string 35. The tool face angle of the drilling motor may be used to correct or adjust the azimuth and inclination of the wellbore 33 during slide drilling. The rig operator ("driller") may operate the top drive 27 to change the tool face orientation of the steerable motor 41 by rotating the entire drill string 35. A top drive 27 for rotating the drill string 35 is illustrated in FIG. 1. Other equipment includes a rotary table and kelly bushing (neither shown) to apply torque to the drill string 35.

Drilling fluid is delivered to the interior of the drill string 35 by mud pumps 43 through a mud hose 45. During rotary drilling, the drill string 35 is rotated within the well bore 33 by the top drive 27. The top drive 27 is slidingly mounted in the mast on parallel vertically extending rails (not shown) to resist rotation as torque is applied to the drill string 35. During slide drilling, the drill string 35 may be held rotationally in place by the top drive 27 while the drill bit 40 is rotated by the steerable motor 41. The steerable motor 41 is ultimately supplied with drilling fluid by the mud pumps 43 through the mud hose 45 and through the drill string 35. The cuttings produced as the drill bit 40 drills into the subsurface formations are carried out of the wellbore 33 by the drilling fluid supplied by the mud pumps 43. The discharge side of the mud pumps 43 may include a drill string pressure sensor 63. The drill string pressure sensor 63 may be in the form of a pump pressure transducer coupled to the mud hose 45 running from the mud pumps 43 to the top drive 27. The pressure sensor 63 makes measurements corresponding to the pressure inside the drill string 35. Some implementations of the instrumented top sub 29, for example, may include a pressure sensor.

In view of prior drilling systems, there is a need for drilling system to perform some directional drilling operations with no, or at least minimum, equipment in the well-bore, i.e., no measurement while drilling MWD in the well-bore.

SUMMARY OF INVENTION

In accordance with the teachings of the present disclosure, disadvantages and problems associated with existing drill rig control systems are alleviated.

According to one aspect of the invention, there is provided a method to determine the tool-face of some down-hole drilling components from the tool-face of the top-drive quill, by including the angular offset between the top drive and the down-hole drilling component. The drilling rig may be equipped with sensors to determine and monitor the angular offset above the rig floor at the top drive or the iron rough neck. By proper computation, the overall angular offset between the top drive and the down-hole drilling component may be tracked. This allows control of the tool-face of the down-hole drilling component relative to the top drive quill tool-face so as to allow some directional drilling operations to be performed with no, or at least minimum, equipment in the well-bore, i.e., no MWD in the well-bore.

According to one aspect of the invention, there is provided a process for directional operations in a well bore, the process comprising: engaging an upper end of a drill string with a traveling block component, wherein the traveling block component comprises a traveling block angular sensor; measuring with the traveling block angular sensor an initial angular position of the drill string; lowering the drill string in the well bore with the traveling block component; measuring with the traveling block angular sensor a final angular position of the drill string; recording an angle of rotation, if any, of the drill string between initial and final positions as measured by the traveling block angular sensor; engaging the drill string with a rig floor component, wherein the rig floor component comprises a rig floor angular sensor; measuring with the rig floor angular sensor an initial angular position of the drill string; disengaging the traveling block component from the drill string; raising the traveling block component; engaging an upper end of a first tubular with the traveling block component; joining a bottom end of the first tubular to the drill string; measuring with the rig floor angular sensor a final angular position of the drill string; and recording an angle of rotation, if any, of the drill string that occurred between initial and final positions as measured by the rig floor angular sensor.

A further aspect of the invention provides a system for directional operations in a well bore, the system comprising: a traveling block component that engages a drill string, wherein the traveling block component comprises a traveling block angular sensor; a rig floor component that engages the drill string, wherein the rig floor component comprises a rig floor angular sensor; a control system comprising: a processor; a non-transitory storage medium; and a set of computer readable instructions stored in the non-transitory storage medium and when executed by the processor configured to: record a measurement received from the traveling block angular sensor of an initial angular position of the drill string; record a measurement received from the traveling block angular sensor of a final angular position of the drill string; determine an angle of rotation, if any, of the drill string between initial and final positions as measured by the traveling block angular sensor; record a measurement received from the rig floor angular sensor of an initial angular position of the drill string; record a measurement received from the rig floor angular sensor of a final angular position of the drill string; and determine an angle of rotation, if any, of the drill string between initial and final positions as measured by the rig floor angular sensor.

According to another aspect of the invention, there is provided a process for directional operations in a well bore, the process comprising: engaging an upper end of a drill string with a traveling block component, wherein the traveling block component comprises a traveling block angular sensor; measuring with the traveling block angular sensor an initial angular position of the drill string; lowering the drill string in the well bore with the traveling block component; measuring with the traveling block angular sensor a final angular position of the drill string; recording an angle of rotation, if any, of the drill string between initial and final positions as measured by the traveling block angular sensor; engaging the drill string with a rig floor component, wherein the rig floor component comprises a rig floor angular sensor; measuring with the rig floor angular sensor an initial angular position of the drill string; disengaging the traveling block component from the drill string; raising the traveling block component; engaging an upper end of a first tubular with the traveling block component; joining a bottom end of the first tubular to the drill string; measuring with the rig floor angular sensor a final angular position of the drill string; recording an angle of rotation, if any, of the drill string that occurred between initial and final positions as measured by the rig floor angular sensor; and determining a first offset between a direction that the first tubular faces and a reference direction, wherein the first offset is based at least in part on the respective recorded angles of rotation measured by the traveling block angular sensor and the rig floor angular sensor.

BRIEF DESCRIPTION OF DRAWINGS

A more complete understanding of the present embodiments may be acquired by referring to the following description taken in conjunction with the accompanying drawings, in which like reference numbers indicate like features.

The objects and features of the invention will become more readily understood from the following detailed description and appended claims when read in conjunction with the accompanying drawings in which like numerals represent like elements.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DESCRIPTION OF EMBODIMENTS

Preferred embodiments are best understood by reference to FIGS. 1-5 below in view of the following general discussion. The present disclosure may be more easily understood in the context of a high level description of certain embodiments.

According to aspects of the invention, the drilling rig may be equipped with torque factor measurement systems at the top drive, the top drive elevator, the iron-roughneck and the rotary table. Torque factor is the rotary horsepower divided by the rotary speed in rpm of a drilling rig. With such measurements, the angular offset between the upper box of drill-string and the top drive quill can be determined during the addition of a tubular (or stand) to the drill-string. The sum of all angular offsets (individual angular offsets occurring with each tubular (or stand) being made-up in the drill-string) allow a determination of the angular offset between the reference tool-face of the down-hole drilling component(s) and the tool-face of the top drive quill. According to one simple application, the drilling rig operator can orient the bend-housing of a down-hole steerable motor by properly setting the angular position of the tool-face of the top drive quill. With adequate implementation of the rig control-system, angular orientation of down-hole tools can be automatic. Additionally, if the top drive is equipped with systems to measure the torque along the drill string, down-hole tool-face orientation may be corrected to include the effect of the torsion of the drill-string due to the torque along the drill-string. Such an application may require the use of a quill-sub to measure torque.

This method of tool-face control from surface can be useful for multiple rig operations, where no MWD is in the well:

- Steering with a drilling motor;
- Setting of a whipstock in vertical or low deviation cased well; and
- Kick-off below casing shoe (to avoid magnetometer interference with the casing).

With adequate acquisition systems and control systems, the rig system can measure the angular offset for each addition of tubular (or stand of tubulars) and also compute the overall angular tool-face offset between the down-hole drilling system and the top drive quill. Furthermore, the rig system can determine instantaneously the tool-face of the down-hole component, including the correction for the torsion of the drill-string due to applied drilling torque.

Figure 1:
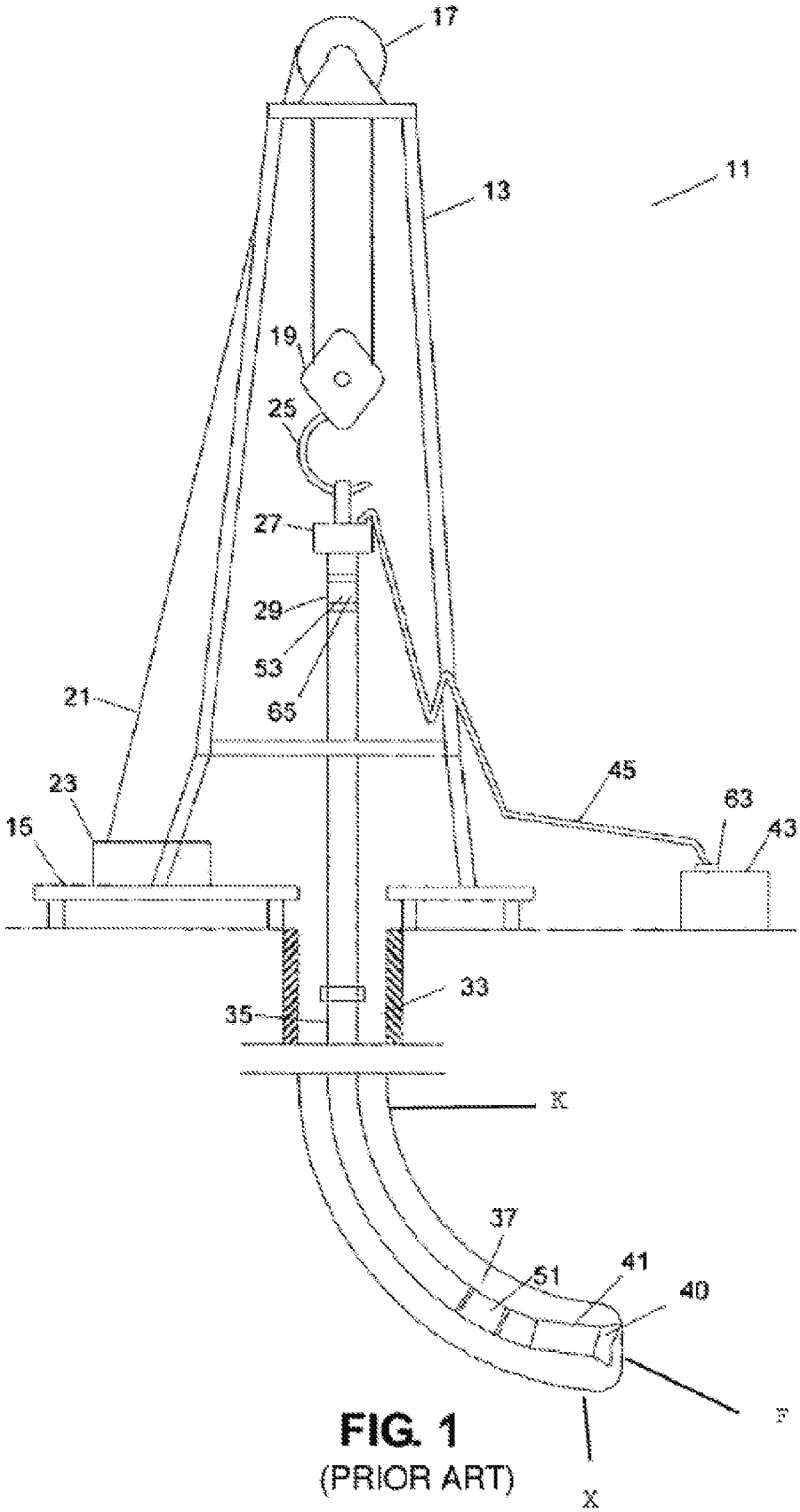
FIG. 1 (PRIOR ART)
FIG. 1 is a schematic illustration of a side view of a drill rig derrick with an MWD sensor downhole according to the prior art.
Figure 2A:
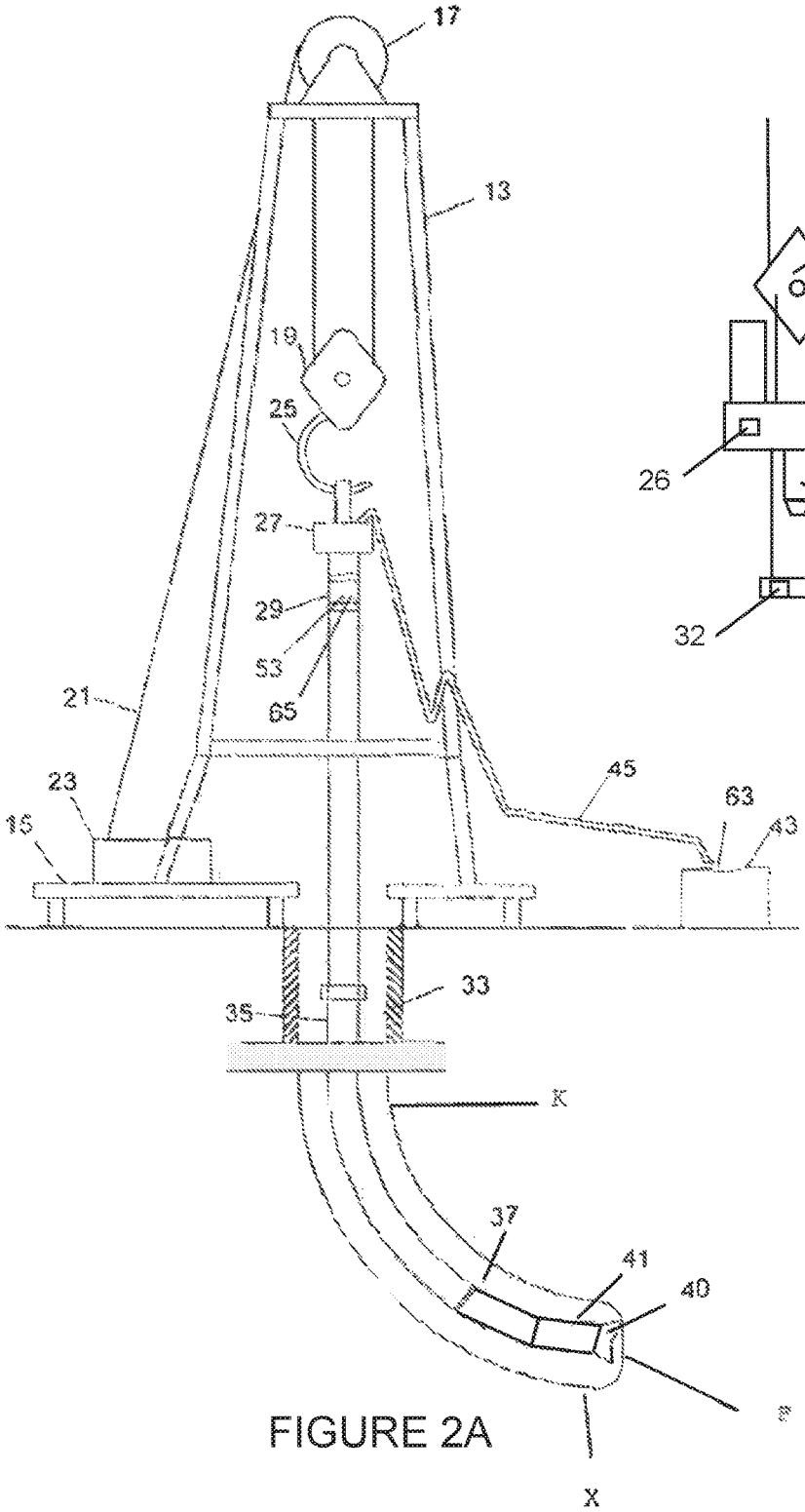
FIG. 2A is a schematic illustration of a side view of a drill rig derrick without an MWD sensor downhole according to an embodiment of the present invention.

FIG. 2 shows a drilling rig ("rig") 11 of the present invention that includes a derrick 13 that is supported on the ground above a rig floor 15. The features of the drilling rig are similar to those described previously with reference to FIG. 1. However, in this drilling system, there is no directional sensor or MWD tool face angle sensor in the bottom hole assembly BHA 37.

FIGS. 3A through 3D illustrate side views of a drilling system of the present invention in various stages of drilling a wellbore. In particular, these figures illustrate how the system keeps track of the angular offset between the bottom-hole tool face and the top drive quill 30 (see FIG. 2B) during the addition of a tubular (or stand) to the drill-string during tripping or drilling operations. The BHA 37 may comprise a bend-housing of a down-hole steerable motor for orienting or steering the bottom-hole tool face.

Figure 3A:
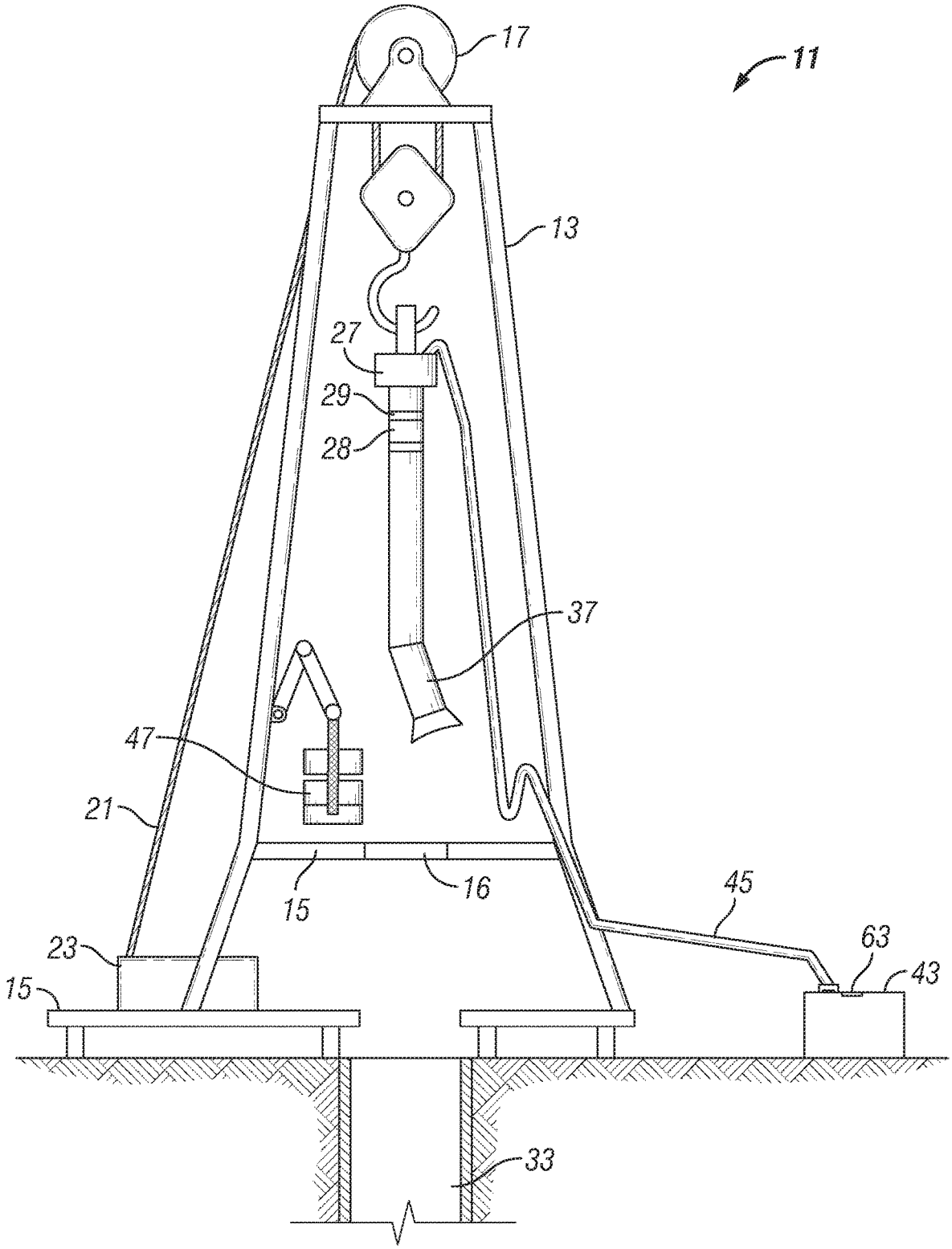
FIG. 3A is a schematic illustration of a side view of a drill rig derrick with a bottom hole assembly suspended from the travelling block component.

FIG. 3A shows a bottom hole assembly BHA 37 suspended from a saver sub 28 below the top drive 27. A system according to one aspect of the invention may comprise an angular measurement in the instrument top sub 29 at the top drive 27. The top drive may be equipped with a sensing method to determine the angular position tool-face of the quill 30. This can be an encoder to track directly the angular position of the quill 30 during rotation. This can be obtained by magnetic pick-up(s) in the vicinity of the teeth of the main quill gear. The gear may also be equipped with a magnetic mark to define the "zero" reference for the encoder. With such a system, the encoder can always find its reference of quill angular rotation. For higher resolution, an encoder may be placed on the shaft of the top drive motor. This would multiply the number of pulses per turn in relation to the top drive gear reduction.

The top drive (or even the rig) may be equipped with a set of magnetometers to determine the orientation of the rig compared to the direction toward which a North-seeking arrow of a compass points (magnetic North). This measurement associated with the quill angular position may allow a determination of the azimuth of the quill 30 versus the North reference. The North reference could also be entered manually in the control system to define the azimuth offset between the mast and the North reference. With this configuration, the tool-face of the TD quill may be determined at any moment during static or rotation conditions of the quill.

Figure 3B:
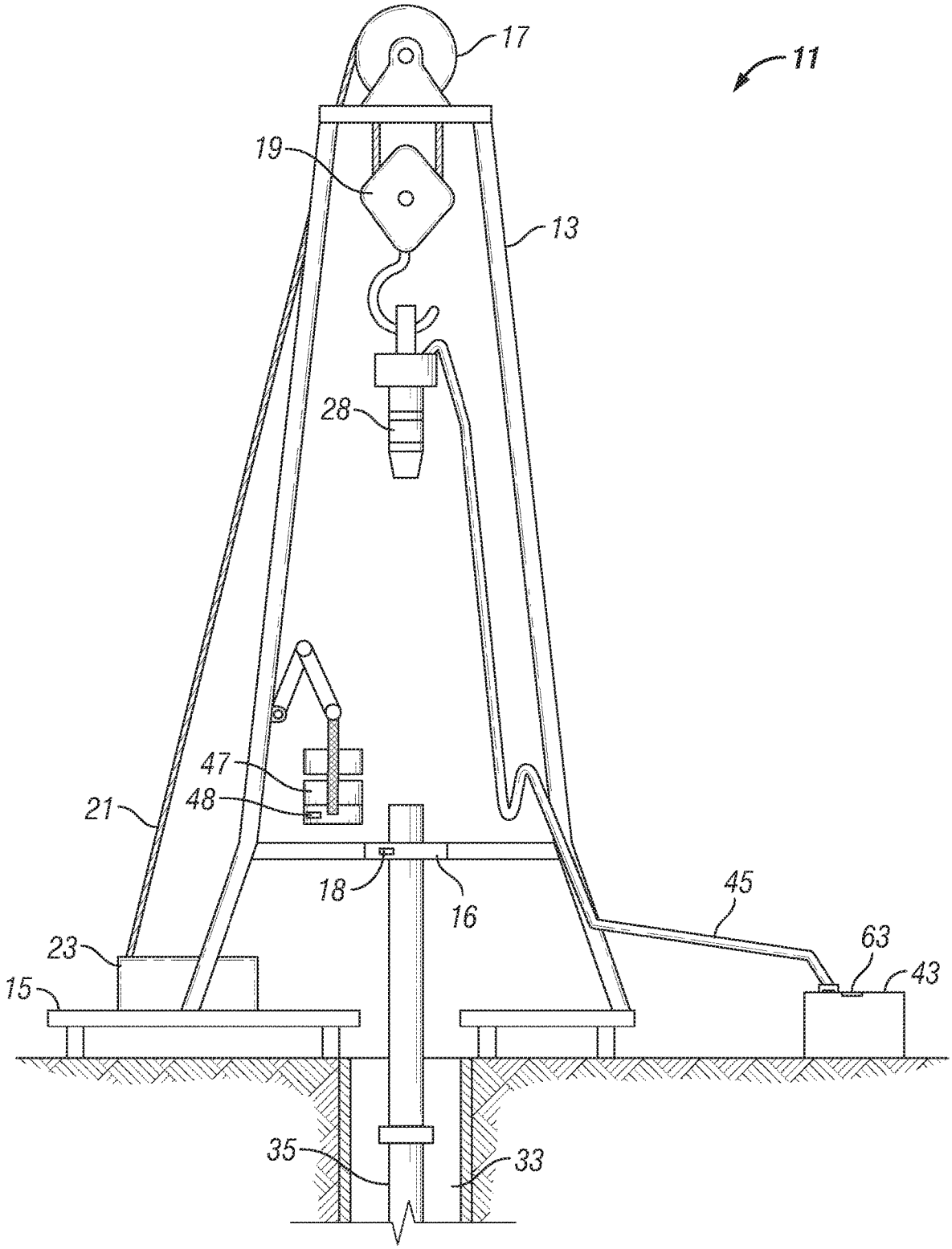
FIG. 3B is a schematic illustration of a side view of a drill rig derrick with a drill string suspended in a rotary table and the traveling block lifted to the top of the derrick.

FIG. 3B shows the system after the BHA 37 has been lowered into the well bore 33 via the draw works 23 letting out cable 21 to lower the travelling block 19. The drill string 35 has been suspended in the well bore 33 via the rotary table 16, the saver sub 28 has been disconnected from the drill string 35, and the travelling block 19 has returned to the top of the derrick 13. The control system has memorized the angular position of the drill string 35 and consequently the tool face of the bottom hole assembly 35 by taking a reading of the top drive quill angular position prior to break-out between the top drive 27 and the drill string 35. The lower tubular or drill string is normally supported by the slips in the rotary table 16 without allowing the drill string 35 to rotate. The system may further allow verification that the drill string has not rotated when "in-slip" in the rotary table 16 in the rig floor 15.

Figure 3C:
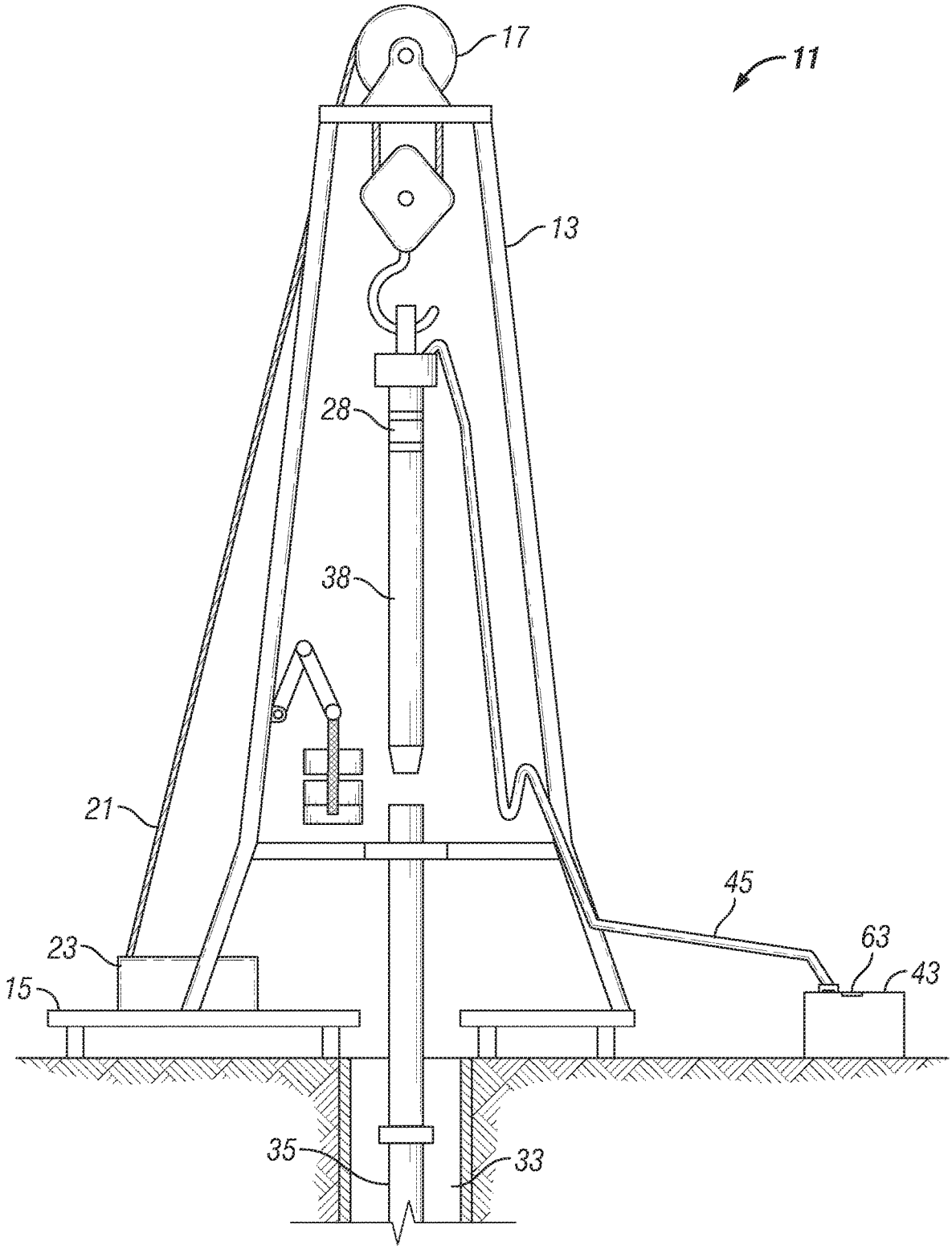
FIG. 3C is a schematic illustration of a side view of a drill rig derrick with a new stand of pipe suspended from the travelling block component.

FIG. 3C shows the system with a new stand 38 of pipe or tubular made up to the saver sub 28 and suspended over the wellbore axis for make-up with the drill string 35.

Figure 2B:
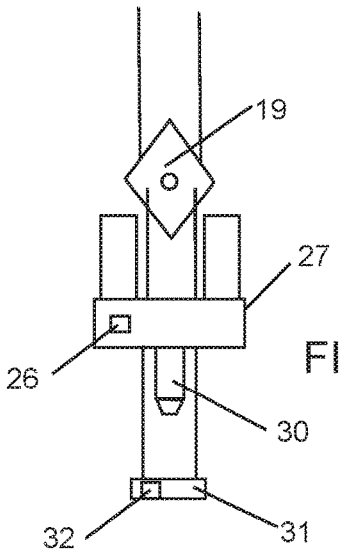
FIG. 2B is a schematic illustration of a side view of a crown block component having a top drive and an elevator.
Figure 3D:
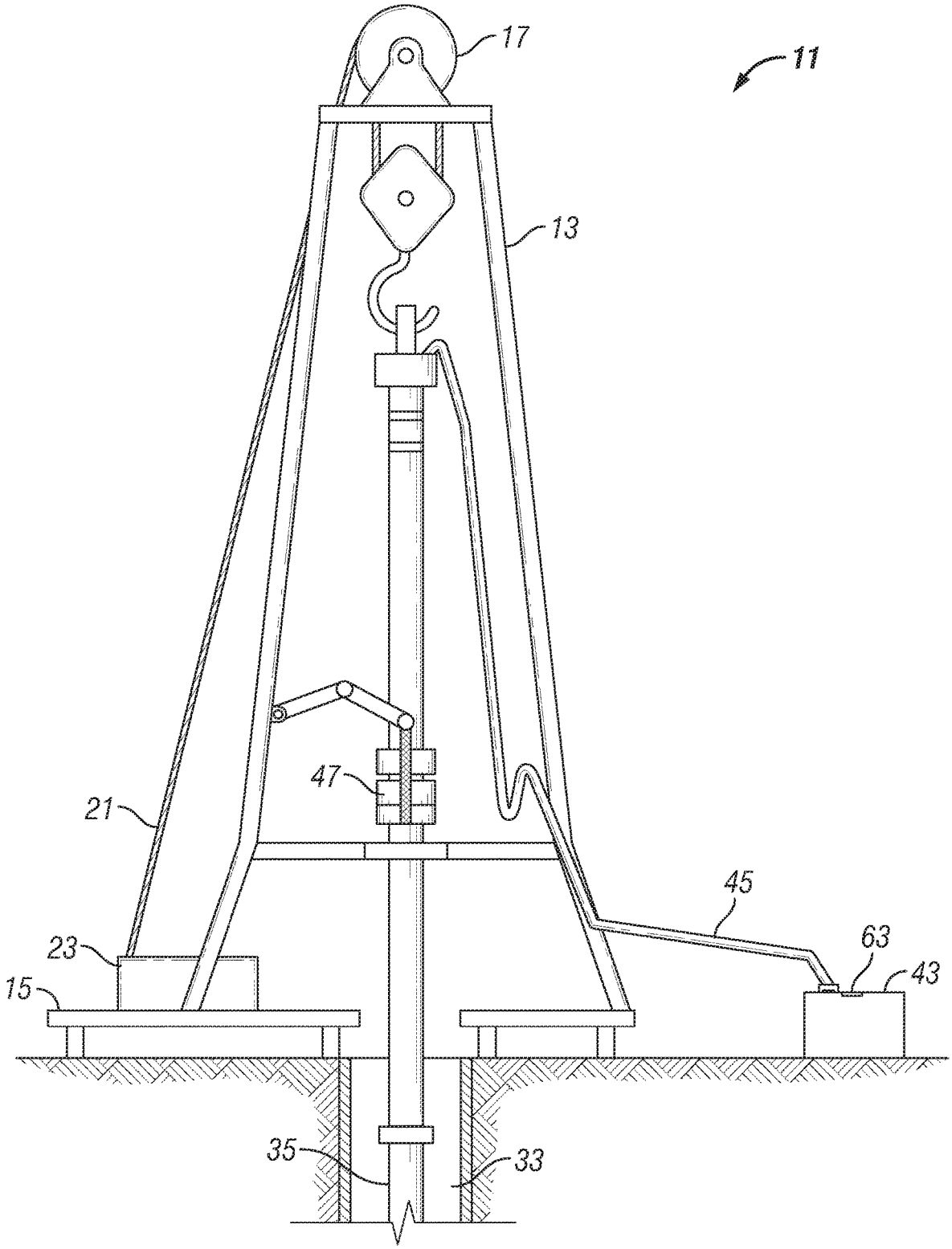
FIG. 3D is a schematic illustration of a side view of a drill rig derrick with an iron roughneck making a connection between a new stand of pipe and the drill string.

FIG. 3D illustrates the system with the stand 38 threaded into the drill string 35 and the iron roughneck 47 in position to make-up the pipe sections. The iron roughneck 47 may be equipped with a sensing system to allow a determination to be made of the angular rotation of the tubular passing through the iron roughneck 47. As a practical implementation, the sensing element may be installed below the lower arm of the iron roughneck to track the (potential) rotation of the lower tubular or drill string in the wellbore 33. Such an angular measurement can be performed via the rotation of a small friction wheel applied by the iron roughneck onto the lower tubular. The rotation of such wheel is determined by encoders. In practical terms, three wheels may be pressed by the iron roughneck 47 onto the periphery of the lower tubular or drill string to determine three times (redundant) the same information: with such implementation, some statistic may be considered between the outputs of the three wheels to potentially reject a wheel which would give a wrong reading. The combination of two rotation measurements, one at the top drive 27 via a top drive sensor 26 (see FIG. 2B) and the other at the iron-roughneck 47 via an iron roughneck sensor 48 (see FIG. 3B), allows the system to observe and memorize the angular offset of the tool face when a stand 38 (or single tubular) is added to the drill string 35.

Figure 4:
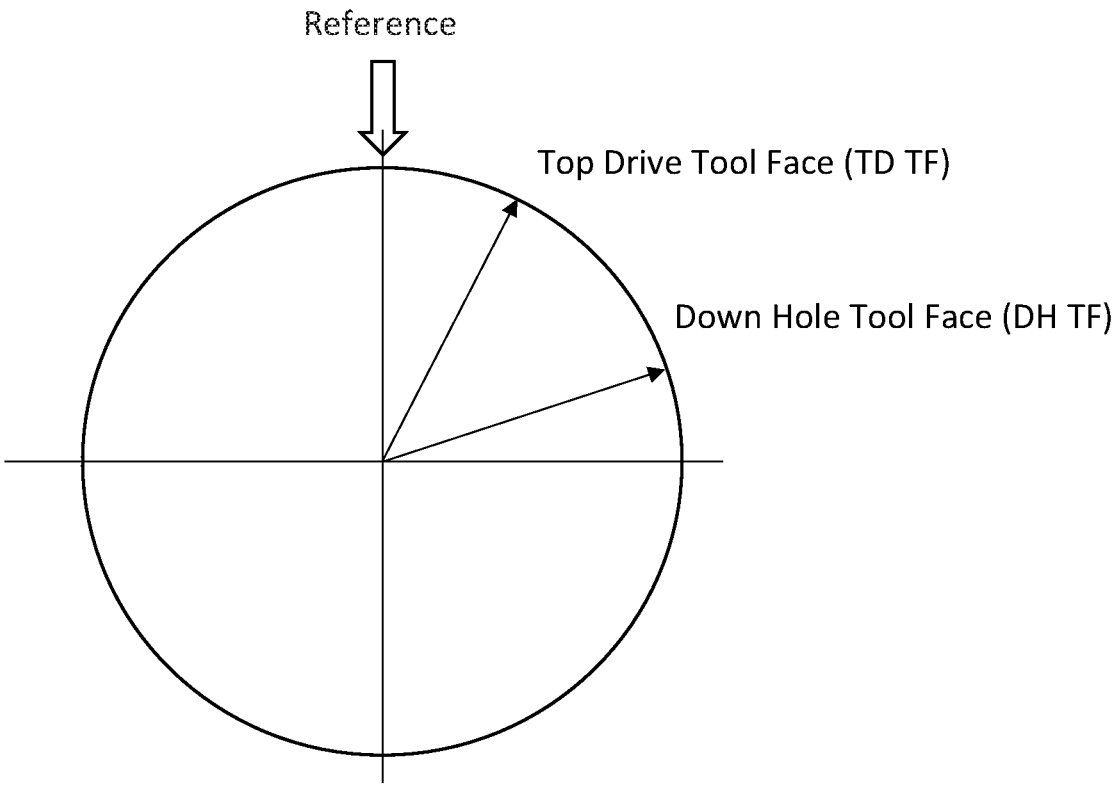
FIG. 4 is a diagram illustrating angles of rotation between a reference direction and directions that tool faces are pointing.

FIG. 4 illustrates a schematic representation of angular positions of the top drive tool face and the down hole tool face relative to a reference on the drill rig. The angular offset between the upper box of drill string and the top drive quill 30 can be determined during the addition of a tubular (or stand) to the drill string. The sum of all angular offsets (individual angular offsets occurring with each tubular (or stand) being made-up in the drill string) allow a determination of the angular offset between the reference tool face of the down hole drilling component(s) and the tool face of the top drive quill 30. In this context, the following definitions are relevant.

TD TF—the top drive tool face is an angle measured in a plane perpendicular to the drill string axis between a drill rig reference (such as magnetic North) and the tool face of the top drive quill.

DH TF—the down hole tool face is an angle measured in a plane perpendicular to the drill string axis between a drill rig reference (such as magnetic North) and the reference tool face of the down hole drilling component(s).

DH TF_Offset—the down hole tool face offset is an angle measured in a plane perpendicular to the drill string axis between the reference tool face of the down hole drilling component(s) and the tool face of the top drive quill.

IR IP—the iron roughneck initial position is a "zero" reference position of the drill string relative to the sensor when the iron roughneck is engaged with the drill string.

IR FP—the iron roughneck final position is a measured angular position of the drill string relative to the sensor when the iron roughneck is disengaged from the drill string.

RT Drift—the rotary table drift is the angular rotation of the drill string as determined by the difference between the iron roughneck initial and final positions.

Figure 5:
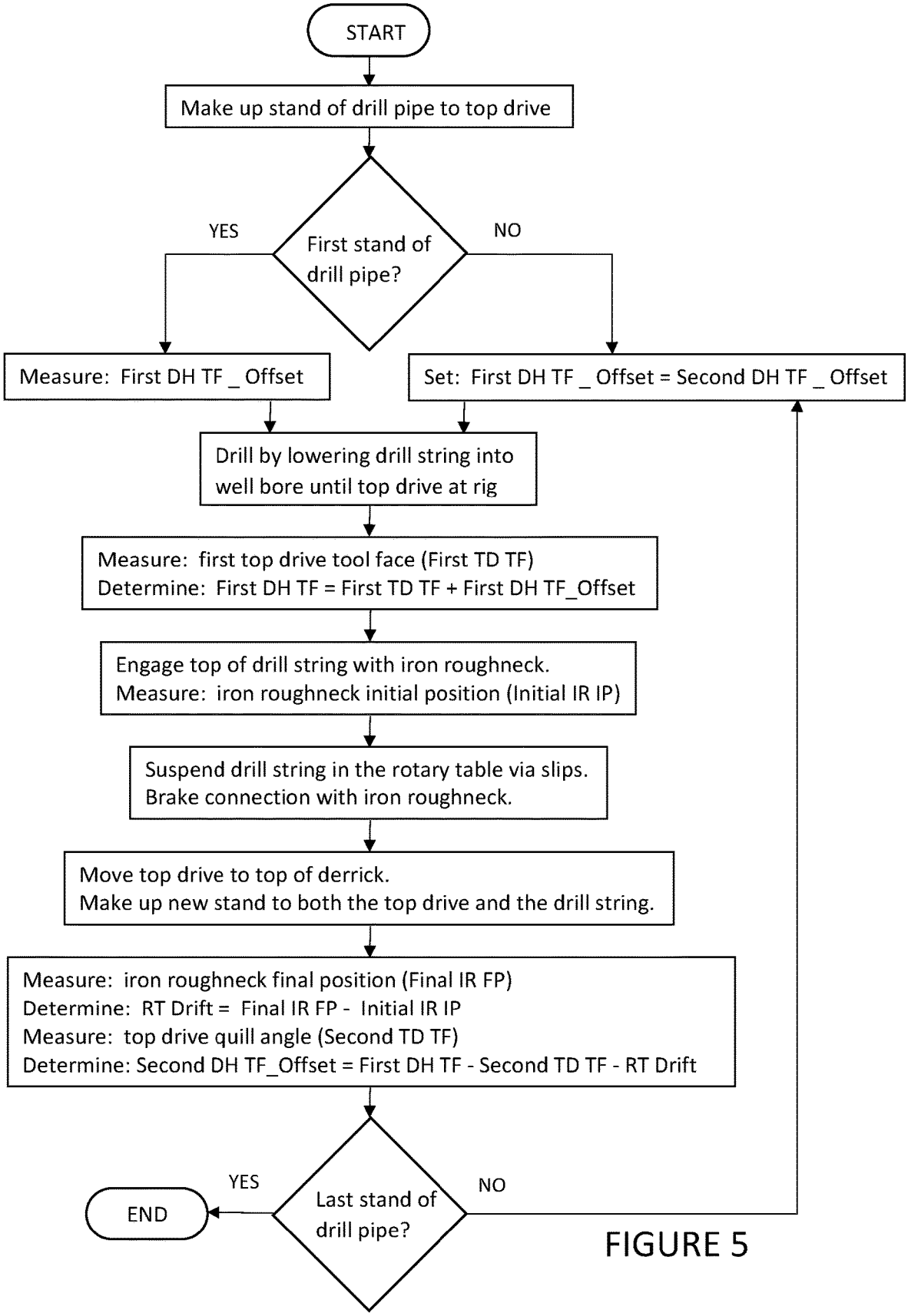
FIG. 5 is a flow chart of a process for monitoring the direction in which a down hole tool faces while making up stands of pipe in a drill string.

FIG. 5 shows a flow chart of a process for drilling according to one aspect of the invention. After the process is started, a stand of drill pipe 38 is made up to the top drive 27. A decision is then made as to whether this is the first stand of pipe being assembled in a drill string. If YES, the down hole tool face offset is measured between the reference tool face of the down hole drilling component(s) and the tool face of the top drive quill (First DH TF_Offset). If NO, the last determined offset will be used (Second DH TF_Offset). Next, the drill pipe is used to drill a well bore via the top drive as the top drive is lowered down to the rig floor 15. The top drive tool face is then measured (First TD TF). The down hole tool face (First DH TF) is then determined to be the sum of the First TD TF and the First DH TF_Offset.

Next, the iron roughneck is engaged with the top of the drill string and an initial position of the drill string (Initial IR IP) is measured. As described above, the angular measurement can be performed via the rotation of a small friction wheel applied by the iron roughneck onto the exterior of the drill string. The drill string is then suspended in the rotary table via slips. The connection between the top drive and the drill string is then broken by the iron roughneck. After disconnection, the top drive is moved upwardly to the top of the rig derrick. Pipe handling equipment is then used to position a new stand of drill pipe at the well bore center. The top drive quill is then made up to the new stand of pipe either directly or through a saver sub. Further, the new stand of pipe is made up to the drill string hanging in the rotary table at the drill rig floor.

With the new stand of pipe made up between the drill string and the top drive, the offset between the reference tool face of the down hole drilling component(s) and the tool face of the top drive quill is then determine. First, the final position of the drill string (Final IR FP) is measured by the iron roughneck sensor 48. (See FIG. 3B). Second, a rotational drift of the drill string during the make-up process is then determined by subtracting the initial position of the drill string in the iron roughneck (Initial IR IP) from the final position of the drill string in the iron roughneck (Final IR FP). Third, the angle of the top drive quill is measured (Second TD TF). Fourth, the offset is determined by subtracting the measured angle of the top drive quill (Second TD TF) from the previously determined down hole tool face (First DH TF). If this is the last stand of drill pipe to be added to the drill string, the process ends. If it is not the last stand of drill pipe, then drilling is continued and the process is repeated with the last determined offset (First DH TF_Offset=Second DH TF_Offset) being used to determine the down hole tool face (First DH TF).

According to an alternative embodiment of the invention, a drilling process provides that when the top drive 27 reaches the drill floor 15, the down hole tool face of the bottom hole assembly 37 (First DH TF) is determined by adding the current top drive tool face (First TD TF) and the lastly accepted downhole tool face offset (First DH TF_Offset) between the down hole tool face and the top drive.

$$\text{First DH TF}=\text{First TD TF}+\text{First DH TF_Offset} \quad (1)$$

After the First DH TF is determined, the slips in the rotary table 16 are set to hold the drill-string in the rig floor 15. The iron roughneck 47 is then installed on the connection above the drill string 35 in the rotary table 16. The readings of the two sensors (top drive and iron roughneck) are acquired, whereby the control system determines a Second TD TF at the top drive 27 and a First IR Angle at the iron roughneck 47. The iron roughneck 47 then breaks the connection and the top drive 27 moves upward in the derrick 13. A new stand 38 is inserted between the drill string 35 in the rotary table slip and the top drive quill. Torque is applied to both ends of the new stand 38 to make up the stand 38 to the top drive 27 and to make up the stand 38 to the drill string 35. The drill string 35 suspended in the rotary table 16 is normally not rotated during the whole process.

The angular rotation sensor(s) of the iron roughneck 47 indicate of the final position of the stand 38 now made up to the drill string 35 in the rotary table 16, called Second IR Angle. A potential angular drift at the rotary table may also be determined:

$$\text{RT Drift}=\text{Second IR Angle}-\text{First IR Angle} \quad (2)$$

In normal conditions, the angle should not have changed so that the RT Drift will be zero. However, the iron roughneck 47 may have allowed the drill string 35 to rotate due to failure to sufficiently grip the pipe.

The actual top drive tool face measurement Second TD TF is acquired also after this installation of the new stand 38. The new down-hole tool-face offset between the down-hole system and the up-hole system is determined:

$$\text{Second DH TF_Offset}=\text{First DH TF_Offset}+\text{Second TD TF}-\text{First TD TF}-\text{RT Drift} \quad (3)$$

After the Second DH TF_offset is determined, the iron-roughneck 47 and the slips of the rotary table 16 may be removed. The top drive may move the drill string both rotation and axially to trip the drill string 35 into the well bore.

Measurement of the top drive tool face TD TF may be performed any time to obtain the Third TD TF. The actual down-hole tool-face Third DH TF can be determined:

$$\text{Third DH TF}=\text{Third TD TF}+\text{Second DH TF_Offset} \quad (4)$$

A similar process can be handled during trip-in, allowing continuous updating of the $N^{th}$_DH TF_Offset. During trip operations, the top drive quill may not be connected at the top of the drill string while lowering the drill-string in the well-bore, but rather an elevator 31 (see FIG. 2B) hanging from the top drive 27 may be used. In such case, an angular position sensor in the top drive elevator may be used. Its construction may be the same as the sensors in the iron-roughneck, and allows determination of the angular offset due to rotation of the tubular in the elevator 31 during its handling and its torqueing onto the tubular (drill string) in the slip of the rotary table.

DH TF_Offset—the down hole tool face offset is an angle measured in a plane perpendicular to the drill string axis between the reference tool face of the down hole drilling component(s) and a drill rig reference (such as magnetic North).

EL IP—the elevator initial position is a "zero" reference position of the drill string relative to the sensor when the elevator is engaged with a stand of pipe.

EL FP—the elevator final position is a measured angular position of the drill string relative to the sensor when the elevator is disengaged from the new stand of pipe or drill string.

EL Drift—the rotary table drift is the angular rotation of the drill string as determined by the difference between the elevator initial and final positions.

The top drive elevator 31 lowers the drill-string in the well. The latest accepted tool-face offset between the down-hole system and the drill rig reference (such as magnetic North) has been previously determined and is known and called Fourth DH TF_Offset. Then, the slips are installed in the rotary table to support the drill-string. The elevator 31 is released and raised in the mast. The iron-roughneck is installed on the box of the tubular (drill string) in the slip such that it grabs and locks the box. Also, the angular rotation sensors of the iron roughneck monitor rotation of the drill string by noting an initial (zero) position of the drill string (Fourth IR IP).

An additional tubular or set of tubulars (stand) is suspended above the drill string in the slip of the rotary table. This may be performed in the conventional way via a pipe handler. The iron roughneck applies the torque between this new tubular (stand) and the drill string in the slip of the rotary table to make up the joint. When the rotation and torquing of the new tubular is completed, the angular position of the drill string is determined by the iron-roughneck sensor and called Fifth IR FP. A determination of the potential angular drift is then made at the rotary table:

$$\text{Fifth RT Drift}=\text{Fifth IR FP}-\text{Fourth IR IP} \tag{5}$$

In normal conditions, the angle of the drill string below the iron roughneck and the down hole tool face should not have changed when the new stand of tubular is made up. However, the iron roughneck may have allowed the lower tubular to rotate due to lack of gripping.

The new down-hole tool-face offset between the down-hole system and the up-hole system is determined:

$$\text{Fifth DH TF_Offset}=\text{Fourth DH TF_Offset}+\text{Fifth RT Drift} \tag{6}$$

The top drive elevator 31 is then made to engage the top of the drill-string. Before the iron roughneck releases the drill string, the sensor(s) of the top drive elevator note an elevator initial position at a "zero" reference position of the drill string relative to the sensor when the elevator is engaged with the made up stand of pipe (Fifth EL IP). The top drive elevator sensor 32 is shown in FIG. 2B.

The iron roughneck and rotary table release the drill string and the top drive lowers the drill string in the well bore until the top drive reaches a lower position near the rig floor. The slips in the rotary table are installed to suspend the drill string in the rotary table. The iron roughneck is again engaged with the drill string and its angular rotation sensor is applied. The sensor(s) of the top drive elevator determine the final angular position, called the Sixth EL FP. A determination of the potential angular drift within the elevator 31 is then made:

$$\text{Sixth EL Drift}=\text{Sixth EL FP}-\text{Fifth EL IP} \tag{7}$$

Under normal conditions, there should be no angular drift. However, the top drive elevator may have let the drill string rotate due to lack of gripping.

Next, the new down hole tool face offset between the down hole system and the up hole system is determined:

$$\text{Sixth DH TF_Offset}=\text{Fifth DH TF_Offset}+\text{Sixth EL Drift} \tag{8}$$

The trip-in process may be continued with additional stands of tubulars by repeating the trip-in process outlined above.

According to an alternative embodiment of the invention, an additional angular sensor may be installed at the rotary table (see rotary table sensor 18 in FIG. 3B) to potentially correct any rotation imposed by the rotary table on the drill string when the drill string is in slip. The rotation sensor may be an encoder on the shaft of the rotary table or on the motor shaft. When the hookload sensor indicates that the drill string is supported by the rotary table, any angle of rotation of the rotary table may be used to adequately correct (if needed) the tool face offset from down hole to up hole.

In a further embodiment, a complementary "table to slip" rotation drift sensor may be installed at the rotary table to determine any potential rotation drift between the rotary table and the slip itself. A measured drift can be subtracted from any rotation of the rotary table, as measured by the rotary table rotation sensor. A "table to slip" rotation drift sensor may also be based on a small wheel sensor attached to the slip and rolling on the rotary table (when drift/rotary slippage) occurs.

A complementary "slip to string" rotation drift sensor may also be installed on the slip to measured potential rotation drift between the slip and the tubular in slip. Such sensors can be similar as the previous one (including wireless data transmission). Such measured angular drift can be subtracted from any rotation of the rotary table (measured by the rotary table rotation sensor).

Sensors may transmit the measured data via wireless communication (such as WIFI) to a fixed receiver connected to the main controller which supervises all the needed sensors (various rotations, magnetometers, hookload, etc.).

With sensor implementations of the present invention, it is possible to determine the tool face offset from the down hole drilling system to the upper connection of the drill string, when adding tubular in the drill string. The tool face angle may be monitored when tripping-in with the elevator and/or by adding tubular using the connection to the quill. When the drill string is connected to the quill of the top drive, it is possible to determine the tool face of the down-hole system at any moment based on the angular measurement of the top drive quill.

If the torque at the quill is measured while drilling, it is possible to determine the angular elastic torsion of the drill string and correct the tool face of the down hole drilling system. With such system, it is possible to impose the tool face to some down hole drilling tool (such as drilling bent-motor, or whipstock) and perform directional drilling (such as sliding mode of a motor) with adequate control of the tool face orientation.

When the top-drive is rotating, it is possible to determine at any moment the tool-face of a down-hole tool, allowing potential synchronization of the system. For example, synchronization could be obtained between the acquisition of a down hole tool face measurement transmitted by fast telemetry (low latency) such as WDP and an up hole tool face measurement.

It should be noted that a determination of the tool face provides an understanding of the plane of propagation of the well bore. However, the inclination of the well bore in this plane of propagation may not be known from the proposed method.

Although the disclosed embodiments are described in detail in the present disclosure, it should be understood that various changes, substitutions and alterations can be made to the embodiments without departing from their spirit and scope.

INDUSTRIAL APPLICABILITY

Systems and processes for tracking the angle of the tool face during drilling and tripping operations of the of the present invention have many industrial applications including but not limited to drilling well bores for the oil and gas industry.

What is claimed is:

1. A process for directional operations in a well bore, the process comprising:

engaging an upper end of a drill string with a traveling block component, wherein the traveling block component comprises a traveling block angular sensor;

measuring with the traveling block angular sensor an initial angular position of the drill string;

lowering the drill string in the well bore with the traveling block component;

measuring with the traveling block angular sensor a final angular position of the drill string;

recording an angle of rotation, if any, of the drill string between initial and final positions as measured by the traveling block angular sensor;

engaging the drill string with a rig floor component, wherein the rig floor component comprises a rig floor angular sensor;

measuring with the rig floor angular sensor an initial angular position of the drill string;

disengaging the traveling block component from the drill string;

raising the traveling block component;

engaging an upper end of a first tubular with the traveling block component;

joining a bottom end of the first tubular to the drill string;

measuring with the rig floor angular sensor a final angular position of the drill string; and recording an angle of rotation, if any, of the drill string that occurred between initial and final positions as measured by the rig floor angular sensor.

2. A process for directional operations in a well bore as claimed in claim 1, wherein the traveling block component comprises a top drive.

3. A process for directional operations in a well bore as claimed in claim 1, wherein the traveling block component comprises an elevator.

4. A process for directional operations in a well bore as claimed in claim 1, wherein the rig floor component comprises an iron roughneck.

5. A process for directional operations in a well bore as claimed in claim 1, wherein the rig floor component comprises a rotary table.

6. A process for directional operations in a well bore as claimed in claim 1, further comprising determining an offset between a direction that a down hole component faces and a reference direction, wherein the offset is based on the respective recorded angles of rotation measured by the traveling block angular sensor and the rig floor angular sensor.

7. A process for directional operations in a well bore as claimed in claim 1, further comprising:

measuring with the traveling block angular sensor an initial angular position of the first tubular;

lowering the joined first tubular and drill string in the well bore with the traveling block component;

measuring with the traveling block angular sensor a final angular position of the first tubular;

recording an angle of rotation, if any, of the first tubular between initial and final positions as measured by the traveling block angular sensor;

engaging the first tubular with the rig floor component;

measuring with the rig floor angular sensor an initial angular position of the first tubular;

disengaging the traveling block component from the first tubular;

raising the traveling block component;

engaging an upper end of a second tubular with the traveling block component;

joining a bottom end of the second tubular to the first tubular;

measuring with the rig floor angular sensor a final angular position of the first tubular; and recording an angle of rotation, if any, of the first tubular that occurred between initial and final positions as measured by the rig floor angular sensor.

8. A process for directional operations in a well bore as claimed in claim 7, further comprising:

determining a first offset between a direction that the first tubular faces and a reference direction, wherein the first offset is based at least in part on the respective recorded angles of rotation measured by the traveling block angular sensor and the rig floor angular sensor;

determining a second offset between a direction that the second tubular faces and the reference direction, wherein the second offset is based on the respective recorded angles of rotation measured by the traveling block angular sensor and the rig floor angular sensor; and determining a component offset between a direction that a down hole component faces and the reference direction by adding the first and second offsets.

9. A system for directional operations in a well bore, the system comprising:

a traveling block component that engages a drill string, wherein the traveling block component comprises a traveling block angular sensor;

a rig floor component that engages the drill string, wherein the rig floor component comprises a rig floor angular sensor;

a control system comprising:

a processor;

a non-transitory storage medium; and a set of computer readable instructions stored in the non-transitory storage medium and when executed by the processor configured to:

record a measurement received from the traveling block angular sensor of an initial angular position of the drill string;

record a measurement received from the traveling block angular sensor of a final angular position of the drill string;

determine an angle of rotation, if any, of the drill string between initial and final positions as measured by the traveling block angular sensor;

record a measurement received from the rig floor angular sensor of an initial angular position of the drill string;

record a measurement received from the rig floor angular sensor of a final angular position of the drill string; and determine an angle of rotation, if any, of the drill string between initial and final positions as measured by the rig floor angular sensor.

10. A system for directional operations in a well bore as claimed in claim 9, wherein the traveling block component comprises a top drive.

11. A system for directional operations in a well bore as claimed in claim 9, wherein the traveling block component comprises an elevator.

12. A system for directional operations in a well bore as claimed in claim 9, wherein the rig floor component comprises an iron roughneck.

13. A system for directional operations in a well bore as claimed in claim 9, wherein the rig floor component comprises a rotary table.

14. A system for directional operations in a well bore as claimed in claim 9, wherein the set of computer readable instructions stored in the non-transitory storage medium and when executed by the processor is further configured to:

determine an offset between a direction that a down hole component faces and a reference direction, wherein the offset is based on the respective determined angles of rotation measured by the traveling block angular sensor and the rig floor angular sensor.

15. A system for directional operations in a well bore as claimed in claim 9, wherein the set of computer readable instructions stored in the non-transitory storage medium and when executed by the processor is further configured to:

determine a first offset between a direction that a first tubular made up in a drill string faces and a reference direction, wherein the first offset is based at least in part on the respective recorded angles of rotation measured by the traveling block angular sensor and the rig floor angular sensor;

determining a second offset between a direction that a second tubular made up in the drill string faces and the reference direction, wherein the second offset is based on the respective recorded angles of rotation measured by the traveling block angular sensor and the rig floor angular sensor; and determining a component offset between a direction that a down hole component faces and the reference direction by adding the first and second offsets.

16. A process for directional operations in a well bore, the process comprising:

engaging an upper end of a drill string with a traveling block component, wherein the traveling block component comprises a traveling block angular sensor;

measuring with the traveling block angular sensor an initial angular position of the drill string;

lowering the drill string in the well bore with the traveling block component;

measuring with the traveling block angular sensor a final angular position of the drill string;

recording an angle of rotation, if any, of the drill string between initial and final positions as measured by the traveling block angular sensor;

engaging the drill string with a rig floor component, wherein the rig floor component comprises a rig floor angular sensor;

measuring with the rig floor angular sensor an initial angular position of the drill string;

disengaging the traveling block component from the drill string;

raising the traveling block component;

engaging an upper end of a first tubular with the traveling block component;

joining a bottom end of the first tubular to the drill string;

measuring with the rig floor angular sensor a final angular position of the drill string;

recording an angle of rotation, if any, of the drill string that occurred between initial and final positions as measured by the rig floor angular sensor; and determining a first offset between a direction that the first tubular faces and a reference direction, wherein the first offset is based at least in part on the respective recorded angles of rotation measured by the traveling block angular sensor and the rig floor angular sensor.

17. A process for directional operations in a well bore as claimed in claim 16, further comprising:

measuring with the traveling block angular sensor an initial angular position of the first tubular;

lowering the joined first tubular and drill string in the well bore with the traveling block component;

measuring with the traveling block angular sensor a final angular position of the first tubular;

recording an angle of rotation, if any, of the first tubular between initial and final positions as measured by the traveling block angular sensor;

engaging the first tubular with the rig floor component;

measuring with the rig floor angular sensor an initial angular position of the first tubular;

disengaging the traveling block component from the first tubular;

raising the traveling block component;

engaging an upper end of a second tubular with the traveling block component;

joining a bottom end of the second tubular to the first tubular;

measuring with the rig floor angular sensor a final angular position of the first tubular; and recording an angle of rotation, if any, of the first tubular that occurred between initial and final positions as measured by the rig floor angular sensor; and determining a second offset between a direction that the first tubular faces and a reference direction, wherein the second offset is based at least in part on the respective recorded angles of rotation measured by the traveling block angular sensor and the rig floor angular sensor.

18. A process for directional operations in a well bore as claimed in claim 17, further comprising:

determining a component offset between a direction that a down hole component faces and the reference direction by adding the first and second offsets.

19. A process for directional operations in a well bore as claimed in claim 16, wherein the traveling block component comprises a component selected from top drive and elevator.

20. A process for directional operations in a well bore as claimed in claim 16, wherein the rig floor component comprises a component selected from iron roughneck and rotary table.

* * * * *